US010753157B2

(12) United States Patent
Rahmani

(10) Patent No.: US 10,753,157 B2
(45) **Date of Patent: *Aug. 25, 2020**

(54) DOWNHOLE DRILL BIT CUTTING ELEMENT WITH CHAMFERED RIDGE

(71) Applicant: National Oilwell DHT, L.P., Conroe, TX (US)

(72) Inventor: Reza Rahmani, Spring, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/278,272

(22) Filed: Feb. 18, 2019

(65) Prior Publication Data

US 2019/0178038 A1 Jun. 13, 2019

Related U.S. Application Data

(63) Continuation of application No. 15/302,445, filed as application No. PCT/US2015/026061 on Apr. 16, 2015, now Pat. No. 10,240,399.

(Continued)

(51) Int. Cl.
*E21B 10/567* (2006.01)

(52) U.S. Cl.
CPC ..... *E21B 10/5673* (2013.01); *E21B 10/5676* (2013.01)

(58) Field of Classification Search
CPC ... E21B 10/56; E21B 10/5673; E21B 10/5676
See application file for complete search history.

(56) References Cited

U.S. PATENT DOCUMENTS 3,388,757 A 6/1968 Fittinger
4,333,540 A 6/1982 Daniels et al.
(Continued)

FOREIGN PATENT DOCUMENTS

GB 2353056 A 2/2001
WO 2012/012774 A2 1/2012
(Continued)

OTHER PUBLICATIONS

European Search Report dated Jun. 13, 2019, for European Application No. 19173400.3 (8 p.).
(Continued)

*Primary Examiner* — Giovanna Wright
(74) *Attorney, Agent, or Firm* — Conley Rose, P.C.

(57) ABSTRACT

A cutting element for a drill bit includes a body having a face at an end thereof. The face includes a ramp, a first side region, a second side region, and a ridge thereon. The ramp has a curved edge along a periphery of the face, a first side, and a second side. The first side and the second side extend from opposite ends of the curved edge and converge at a location along the face. The ridge extends along the face from a chamfer along a peripheral edge of the face to the location. The ridge is positioned between the first side region and the second side region. The first side region extends between the periphery, the ridge, and the first side. The second side region extends between the periphery, the ridge, and the second side. The ramp extends from the first side region to the second side region.

29 Claims, 14 Drawing Sheets

Related U.S. Application Data

(60) Provisional application No. 61/980,256, filed on Apr. 16, 2014.

(56) References Cited

U.S. PATENT DOCUMENTS

| | | | |
|---|---|---|---|
| 4,529,048 | A | 7/1985 | Hall |
| 4,570,726 | A | 2/1986 | Hall |
| 4,593,777 | A | 6/1986 | Barr |
| 4,716,977 | A | 1/1988 | Huffstutler |
| 4,724,913 | A | 2/1988 | Morris |
| 4,819,516 | A | 4/1989 | Dennis |
| 4,928,777 | A | 5/1990 | Shirley-Fisher |
| 5,115,873 | A | 5/1992 | Pastusek |
| 5,201,376 | A | 4/1993 | Williams |
| 5,746,280 | A | 5/1998 | Scott et al. |
| 5,819,861 | A | 10/1998 | Scott et al. |
| 5,992,549 | A | 11/1999 | Fuller |
| 6,045,440 | A | 4/2000 | Johnson et al. |
| 6,065,554 | A | 5/2000 | Taylor et al. |
| 6,131,678 | A | 10/2000 | Griffin |
| 6,209,668 | B1 | 4/2001 | Pessier et al. |
| 6,241,035 | B1 | 6/2001 | Portwood |
| 6,328,117 | B1 | 12/2001 | Berzas et al. |
| 6,332,503 | B1 | 12/2001 | Pessier et al. |
| 6,601,662 | B2 | 8/2003 | Matthias et al. |
| 7,588,102 | B2 | 9/2009 | Hall et al. |
| 7,681,673 | B2 | 3/2010 | Kolachalam |
| 7,726,420 | B2 | 6/2010 | Shen et al. |
| 7,798,257 | B2 | 9/2010 | Shen et al. |
| 8,037,951 | B2 | 10/2011 | Shen et al. |
| 8,739,904 | B2 | 6/2014 | Patel |
| 8,783,387 | B2 | 7/2014 | Durairajan et al. |
| 9,051,795 | B2 | 6/2015 | Hall et al. |
| 9,074,435 | B2 | 7/2015 | Scott et al. |
| 10,240,399 | B2 * | 3/2019 | Rahmani ..... E21B 10/5676 |
| 2005/0247492 | A1 | 11/2005 | Shen et al. |
| 2008/0060852 | A1 | 3/2008 | Chandila et al. |
| 2008/0099251 | A1 | 5/2008 | Hall et al. |
| 2009/0159341 | A1 | 6/2009 | Pessier et al. |
| 2010/0059287 | A1 | 3/2010 | Durairajan et al. |
| 2010/0163310 | A1 | 7/2010 | Vempati et al. |
| 2010/0200305 | A1 | 8/2010 | Griffin et al. |
| 2011/0031028 | A1 | 2/2011 | Sreshta et al. |
| 2011/0031036 | A1 | 2/2011 | Patel |
| 2011/0212303 | A1 | 9/2011 | Fuller et al. |
| 2011/0266070 | A1 | 11/2011 | Scott et al. |
| 2012/0018223 | A1 | 1/2012 | Setlur et al. |
| 2012/0152622 | A1 | 6/2012 | Sue et al. |
| 2013/0199856 | A1 | 8/2013 | Bilen et al. |
| 2014/0060934 | A1 | 3/2014 | Disantis |
| 2014/0182947 | A1 | 7/2014 | Bhatia et al. |
| 2014/0183800 | A1 | 7/2014 | Stewart et al. |
| 2014/0196959 | A1 | 7/2014 | Hall et al. |

FOREIGN PATENT DOCUMENTS

| | | | |
|---|---|---|---|
| WO | 2012/056196 | A2 | 5/2012 |
| WO | 2014/036283 | A1 | 3/2014 |
| WO | 2015/161010 | A2 | 10/2015 |

OTHER PUBLICATIONS

PCT/US2015/02606 International Search Report and Written Opinion dated Oct. 22, 2015 (12 pages).
PCT/US2013/057322 International Preliminary Report on Patentability dated Jan. 17, 2014 (5 p.).
PCT/US2013/057322 Written Opinion dated Jan. 17, 2014 (4 p.).
PCT/US2013/057322 International Search Report dated Jan. 17, 2014 (2 p.).
Canadian Office Action dated Mar. 17, 2016, for Canadian Application No. 2,882,310 (4 p.).
J.K. Examination Report dated Jul. 22, 2015, for U.K. Application No. 1502841.8 (1 p.).
Response to U.K. Examination Report dated Jul. 22, 2015, for U.K. Application No. 1502841.8; Response filed Nov. 23, 2015 (10 p.).
MEGADiamond, Ind. Promotional Book dated Dec. 6, 1983, Houston, Texas (17 p.).
GCC Examination Report dated Oct. 29, 2017, for GCC Application No. 2015-29227 (4 p.).
GCC Examination Report dated Aug. 14, 2018, for GCC Application No. 2015-29227 (4 p.).
Australian Examination Report dated Sep. 25, 2018, for Australian Application No. 2015247624 (3 p.).
European Examination Report dated Sep. 6, 2018, for European Application No. 15719110.7 (4 p.).
Office Action dated Jul. 12, 2018, for U.S. Appl. No. 15/302,445 (10 p.).
Response to Office Action dated Jul. 12, 2018, for U.S. Appl. No. 15/302,445; Response filed Oct. 9, 2018 (12 p.).
Notice of Allowance dated Nov. 15, 2018, for U.S. Appl. No. 15/302,445 (10 p.).
European Response to Examination Report dated Sep. 6, 2018, for European Application No. 15719110.7; Response filed Dec. 28, 2018 (7 p.).
European Intention to Grant 71(3) Communication dated Jan. 31, 2019, for European Application No. 15719110.7 (6 p.).

* cited by examiner

FIG. 3A
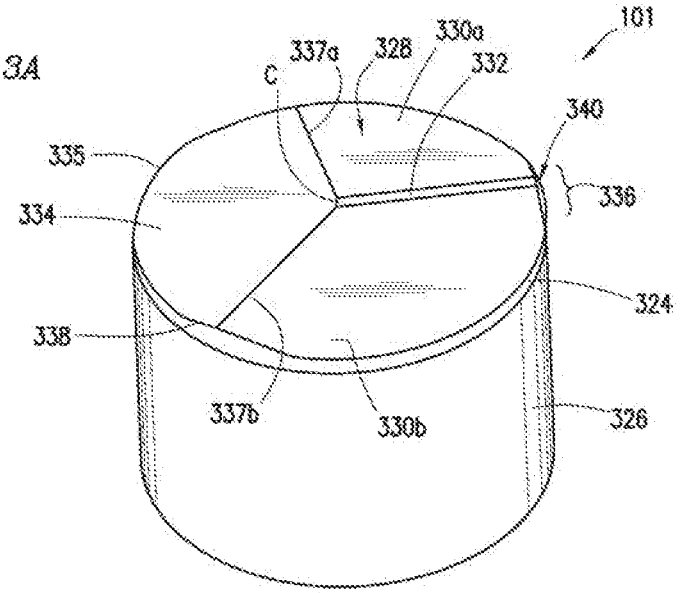
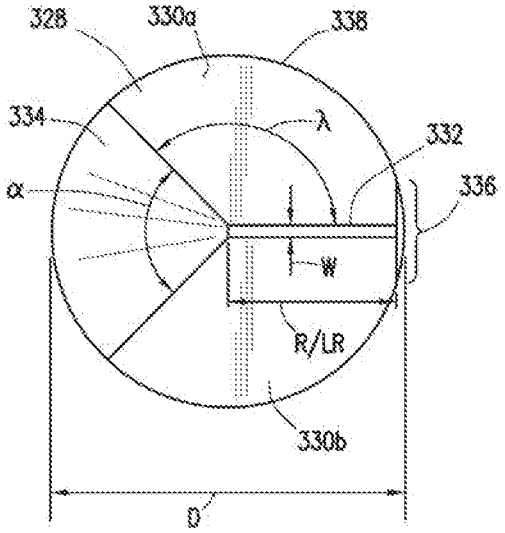
FIG. 3B
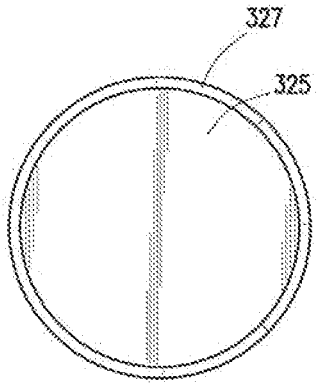
FIG. 3C

DOWNHOLE DRILL BIT CUTTING ELEMENT WITH CHAMFERED RIDGE

CROSS-REFERENCE TO RELATED APPLICATIONS

The present application is a continuation of U.S. application Ser. No. 15/302,445 filed Oct. 6, 2016, and entitled "Downhole Drill Bit Cutting Element with Chamfered Ridge," which is a 35 U.S.C. § 371 national phase application of PCT/US2015/026061 with international filing date of Apr. 16, 2015, and claims priority thereto, and further claims priority to provisional application No. U.S. 61/980,256, filed on Apr. 16, 2014. Each of the above-identified applications is incorporated herein by reference in its entirety for all purposes.

STATEMENT REGARDING FEDERALLY SPONSORED RESEARCH OR DEVELOPMENT

Not applicable.

BACKGROUND

This present disclosure relates generally to drilling equipment used in wellsite operations. More specifically, the present disclosure relates to drill bits and cutting elements used for drilling wellbores.

Various oilfield operations may be performed to locate and gather valuable downhole fluids. Oil rigs are positioned at wellsites and downhole tools, such as drilling tools, are deployed into the ground to reach subsurface reservoirs. The drilling tool may include a drill string with a bottom hole assembly, and a drill bit advanced into the earth to form a wellbore. The drill bit may be connected to a downhole end of the bottom hole assembly and driven by drillstring rotation from surface and/or by mud flowing through the drilling tool.

The drill bit may be a fixed cutter drill bit with polycrystalline diamond compact (PDC) cutting elements. An example of a drill bit and/or cutting element are provided in U.S. Application No. 61/694,652, filed Aug. 29, 2012, entitled Cutting Element for a Rock Drill Bit, published in WO 2014/036283, Mar. 6,2014, the entire contents of which are hereby incorporated by reference herein. Other examples of drill bits and/or cutting elements are provided in W02012/056196, W02012/012774, and US Patent Application Nos. 2012/0018223, 2011/0031028, 2011/0212303, 2012/0152622, and/or 2010/0200305, the entire contents of which are hereby incorporated by reference herein.

SUMMARY

In at least one aspect, the disclosure relates to a cutting element for a drill bit advanceable into a subterranean formation to form a wellbore. The cutting element includes an element body having a face at an end thereof, and a ridge. The element body has a face at an end thereof. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp whereby the chamfer engages a wall of the wellbore and extrudate is drawn along the pair of side regions.

The element body may include a substrate, and/or a diamond layer with the face positioned along a surface of the diamond layer. A ramp angle may be defined between the sides of the ramp (e.g., at about 60 to 90 degrees). A surface angle may be defined along the side regions between the ridge and one of the two sides of the ramp (e.g., at about 135 degrees). A chamfer angle may be defined between a horizontal line and a face of the chamfer (e.g., at about 45 degrees). The ramp and the sides may incline along the periphery. The ramp and the sides may incline along the periphery at an angle of about 10 degrees. The ramp and/or the side regions may be flat and/or have a curved surface.

The location may be positioned about a center of the face or a distance therefrom. The sides may be along a radius of the face. The ridge may be along a radius of the face. The ridge may have a width of 0.40 mm, and/or a height of 0.30 mm. The ridge may have a length ½ of a diameter of the face, or less than ½ of a diameter of the face. The ridge may have a width that narrows or widens away from a center of the face. The chamfer may extend along the periphery between 10 and 360 degrees of the periphery of the face. The chamfer may define a leading edge of the cutting element for engagement with a wall of the wellbore. A bottom of the element body opposite the face has a bevel.

In another aspect, the drill bit is advanceable into a subterranean formation to form a wellbore. The drill bit includes a bit body and at least one cutting element disposable in the bit body. The cutting element includes an element body having a face at an end thereof, and a ridge. The element body has a face at an end thereof. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp whereby the chamfer engages a wall of the wellbore and extrudate is drawn along the pair of side regions.

The bit body may have blades extending radially therefrom, and/or at least one socket to receive the at least one cutting element therein.

Finally, in another aspect, the disclosure relates to a method of advancing a drill bit advanceable into a subterranean formation to form a wellbore. The method involves providing the drill bit with at least one cutting element. The cutting element includes an element body having a face at an end thereof, and a ridge. The element body has a face at an end thereof. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp whereby the chamfer engages a wall of the wellbore and extrudate is drawn along the pair of side regions. The method further involves engaging the chamfer of the drill bit with a wall of the wellbore.

The method may also involve drawing extrudate from the wall of the wellbore down the pair of side regions, and/or flowing fluid down the ramp and toward the chamfer.

BRIEF DESCRIPTION OF THE DRAWINGS

So that the above recited features and advantages can be understood in detail, a more particular description, briefly summarized above, may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

FIGS. 3A-3E are perspective, top, bottom, left side, and rear views of one of the cutting elements having a central configuration.

DETAILED DESCRIPTION

The description that follows includes exemplary apparatuses, methods, techniques, and/or instruction sequences that embody techniques of the present subject matter. However, it is understood that the described embodiments may be practiced without these specific details.

This disclosure is directed to a cutting element (or insert) for a drill bit used to drill wellbores. The cutting element includes a face (or working surface) having at least two side regions with an elongated ridge therebetween, a ramp, and a chamfer. The ridge extends from the chamfer at a periphery of the face to a location along the face (e.g., a central part of the face) to draw extrudates down the pair of side regions. The ramp extends at an angle from the side regions to flow fluid toward the leading edge during drilling.

Figure 1:
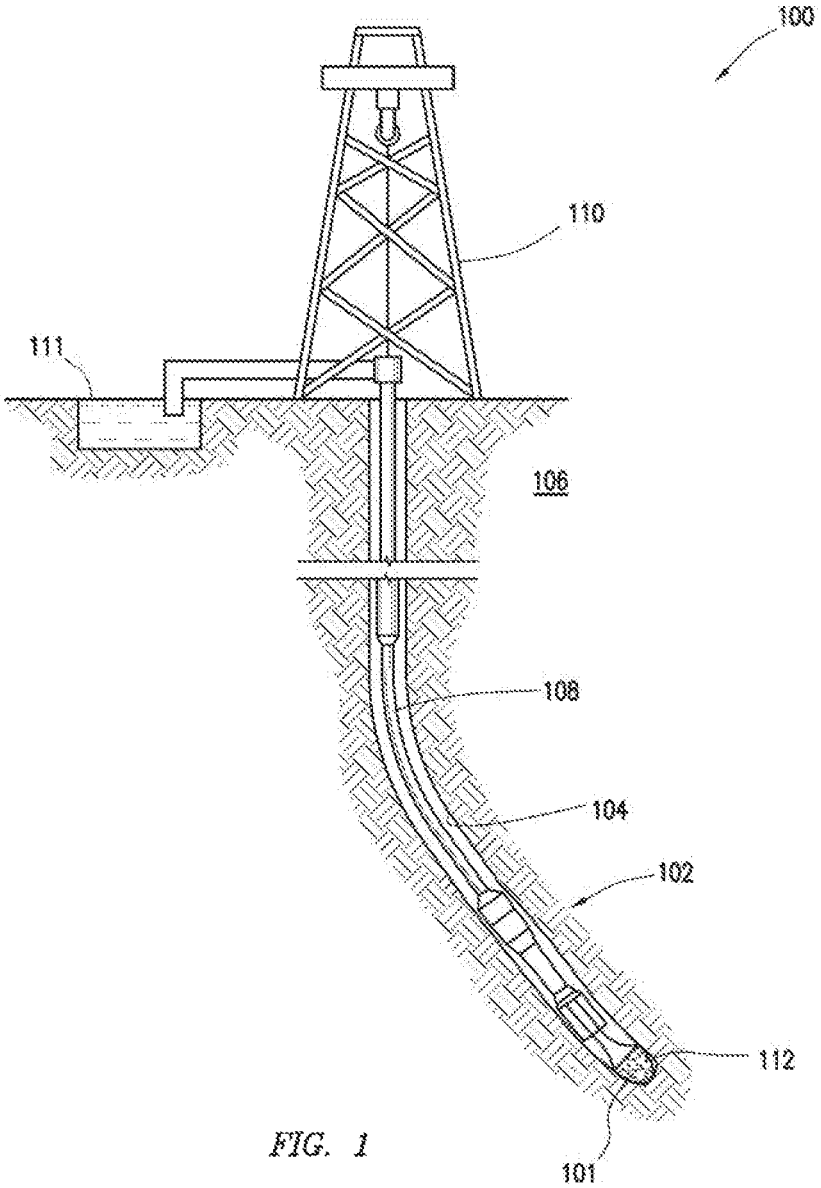
FIG. 1 is a schematic diagram of a wellsite including a rig with a downhole tool having a drill bit advanced into the earth to form a wellbore.

FIG. 1 depicts a wellsite 100 in which the subject matter of the present disclosure maybe used. As generally shown, cutting elements 101 and assemblies and processes employing the cutting elements may be deployed at a downhole end of a downhole tool 102 into a wellbore 104 formed in a subterranean formation 106 by any suitable means, such as by a rotary drill string 108 operated from a drilling rig 110 to rotate a drill bit 112. A mud pit 111 is provided at the wellsite 100 to pass drilling fluid through the downhole tool 102 and out the bit 112 to cool the drill bit 112 and carry away cuttings during drilling.

The "drill string" may be made up of tubulars secured together by any suitable means, such as mating threads, and the drill bit may be secured at or near an end of the tubulars as secured together. As used throughout this description, the term "wellbore" is synonymous with borehole and means the open hole or uncased portion of a subterranean well including the rock face which bounds the drilled hole. As used throughout this description, the terms "environ" and "environs" refers to one or more subterranean areas, zones, horizons and/or formations that may contain hydrocarbons.

The wellbore may extend from the surface of the earth, including a seabed or ocean platform, and may penetrate one or more environs of interest. The wellbore may have any suitable subterranean configuration, such as generally vertical, generally deviated, generally horizontal, or combinations thereof, as will be evident to a skilled artisan.

The quantity of energy referred to as "energy of extrusion" or "EE" means the portion of the total mechanical specific energy ("MSE") that is expended to extrude crushed rock particles across the faces of the cutting element(s) of the drill bit during drilling. As used throughout this description, the term "extrudate" refers to crushed rock particle conglomerates that are extruded across the face of the cutting element(s) during drilling. As also used throughout this description, the term "rock drill bit" refers to a fixed cutter, drag-type rock drill bit.

Figure 2A:
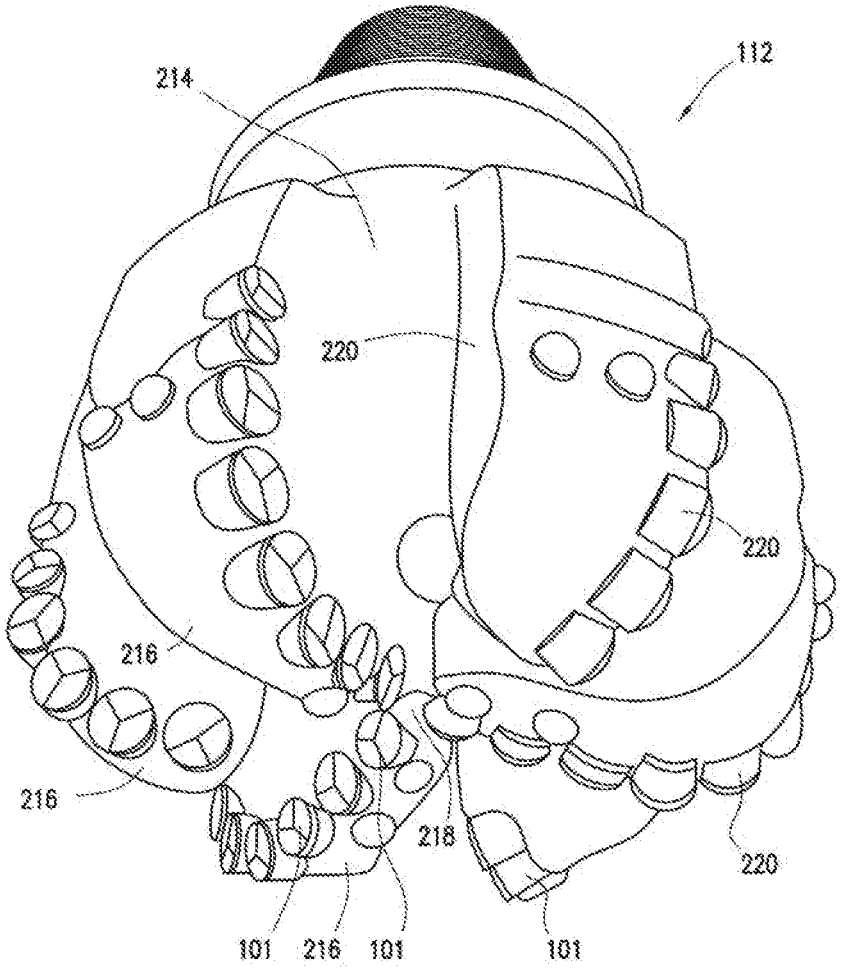
FIGS. 2A and 2B are perspective and end views, respectively, of a fixed cutter drill bit with cutting elements thereon.
Figure 2B:
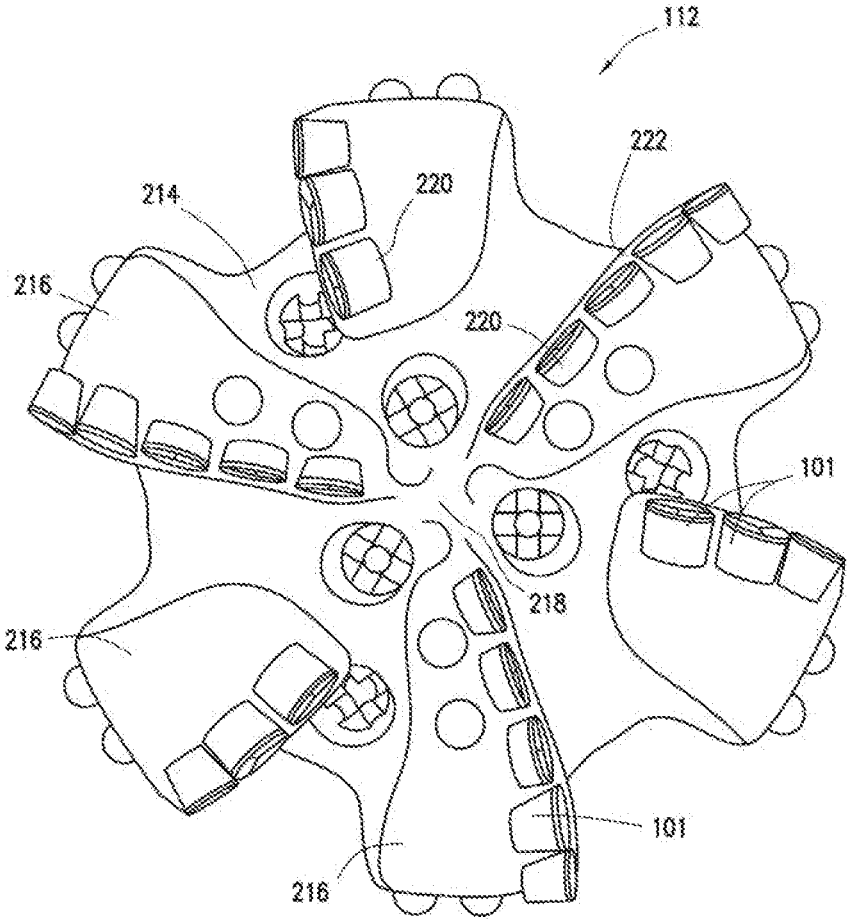
Figure 3E:
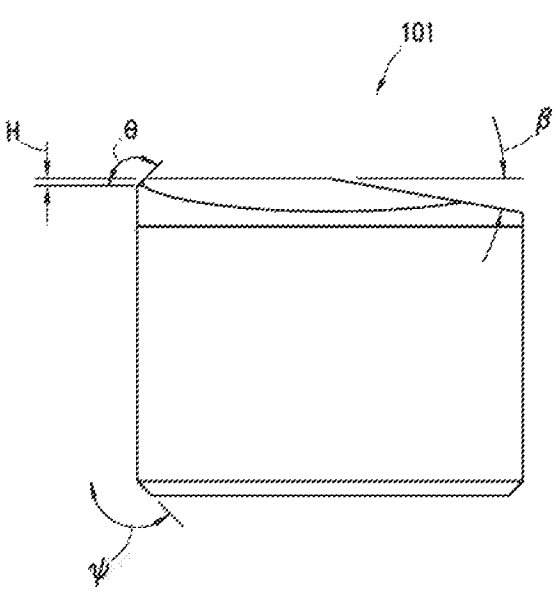
Figure 3D:
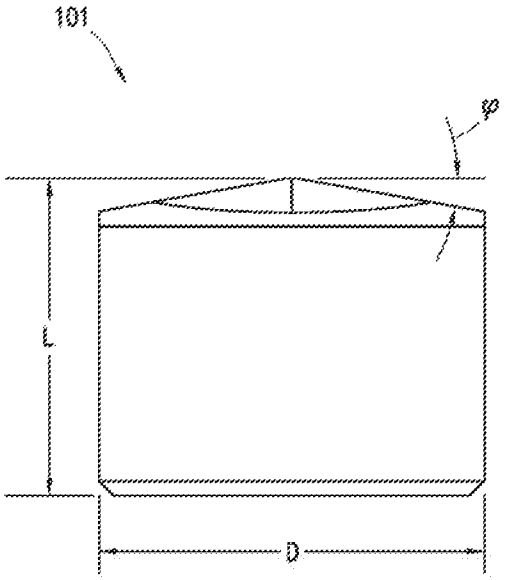
Figure 4B:
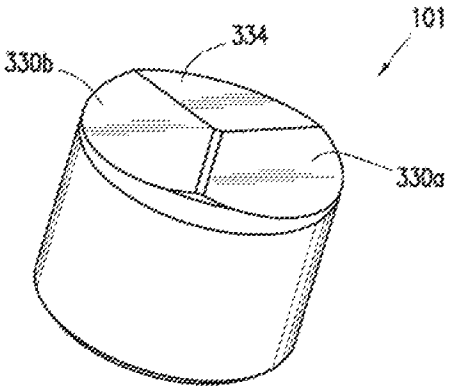
FIGS. 4A-4G are additional perspective and plan views of the cutting element of FIG. 3A.
Figure 4A:
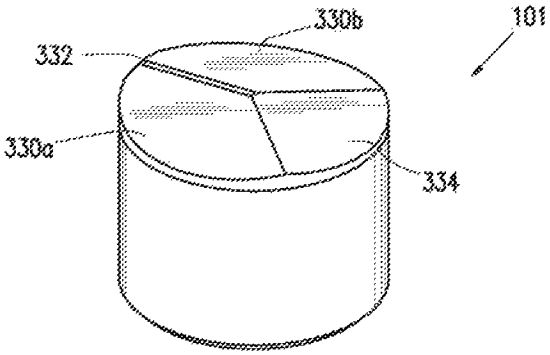
Figure 4C:
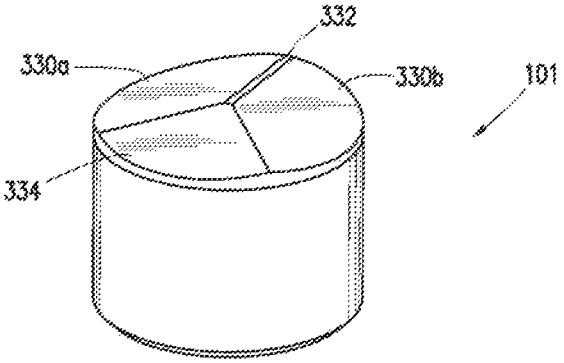
Figure 4E:
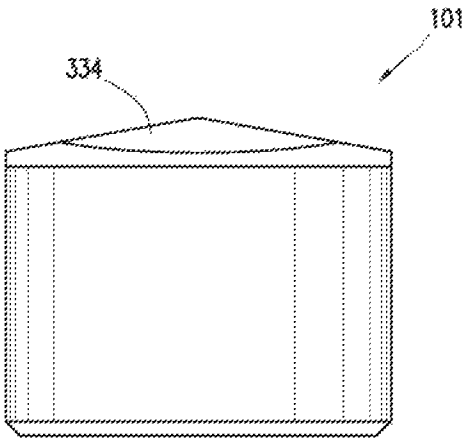
Figure 4D:
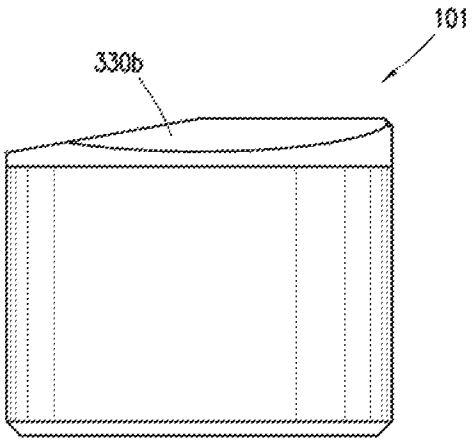
Figure 4G:
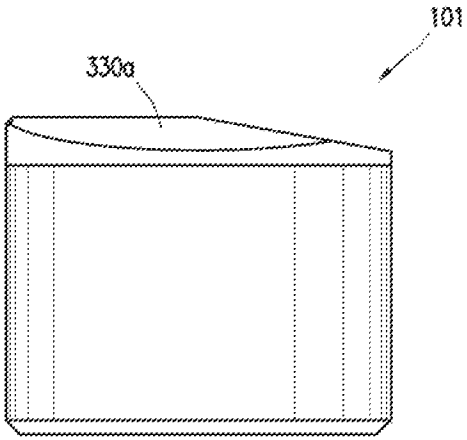
Figure 4F:
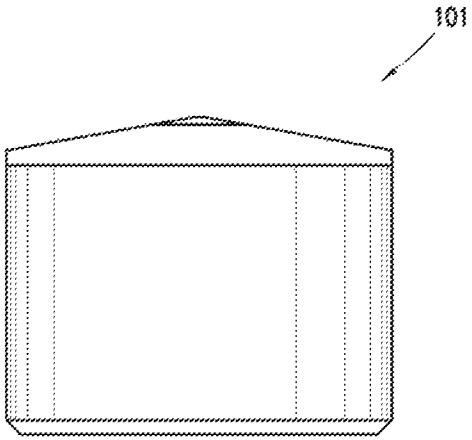
Figure 5B:
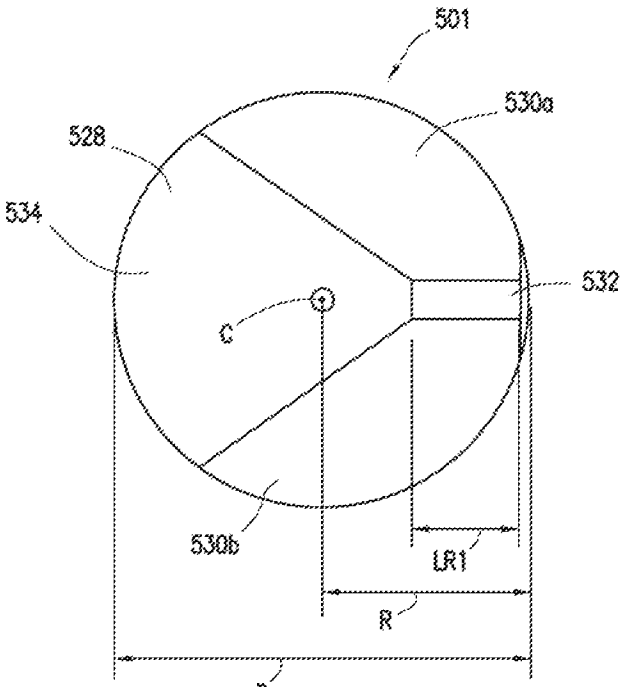
FIGS. 5A-5E are perspective, top, front, rear, and side views, respectively, of a cutting element having an offset configuration.
Figure 5A:
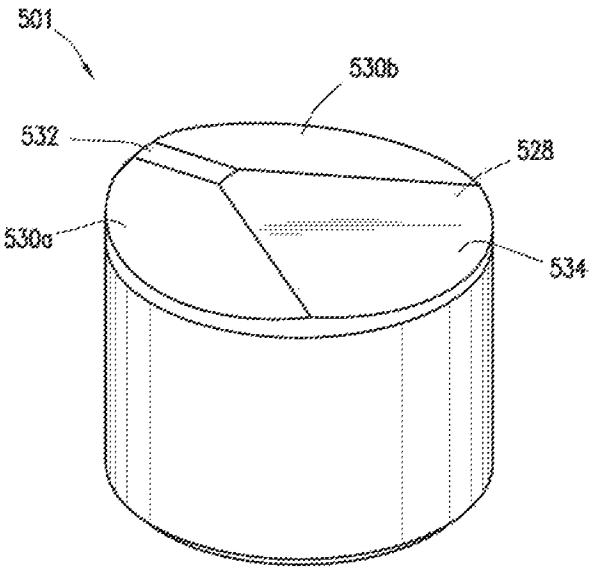
Figure 5D:
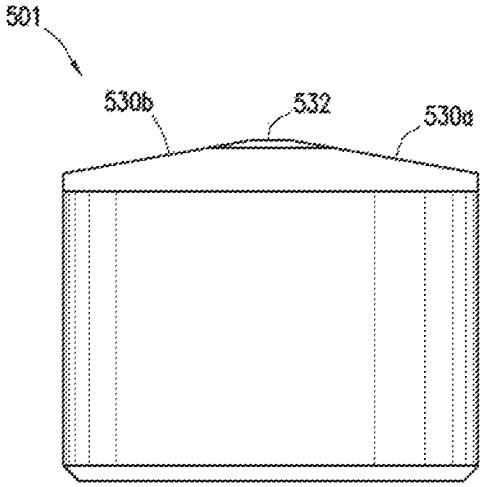
Figure 5C:
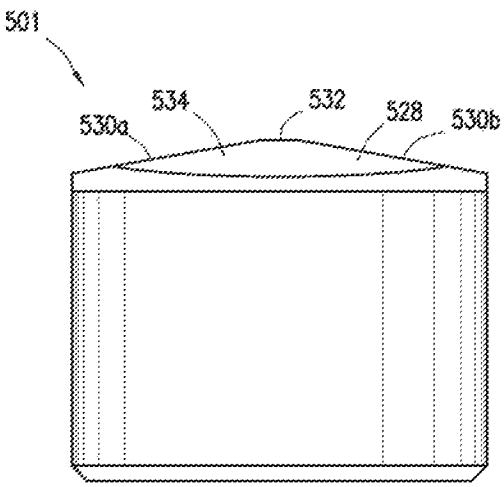

The cutting elements 101 described herein may be utilized in conjunction with any drill bit rotated by means of a drill string to form a wellbore in environs, such as a rotary drag-type rock drill bits. FIGS. 2A and 2B depict an example drill bit 112 that may be used with the cutting elements 101 described herein. As shown, the drill bit 112 is a drag-type rock drill bit having a bit body 214.

The bit body 214 may include one or more blades 216 that protrude from an outer periphery of the bit body 214. The blades 216 extend along a portion of the bit body 214 and terminate on or near a nose end 218 thereof. The nose end 218 is at a central location about an end of the bit body 214 where the blades 216 converge. The bit body 214 may also be provided with one or more passages 222 between the blades 216 for transporting drilling fluid to the surface of the bit body 214 for cooling and/or cleaning exposed portions of the cutting elements 101 during drilling operations.

One or more cutting elements 101 are mounted in at least one of the blades 216 by positioning a portion of each cutting element 101 within a socket 220 and securing it therein by any suitable means as will be evident to a skilled artisan, for example by means of pressure compaction or baking at high temperature into the matrix of the bit body 214. The cutting elements 101 may be positioned in the sockets 220 at a desired orientation.

The cutting elements 101 may be randomly positioned about the bit body 214. The orientation of the cutting elements 101 may optionally be selected so as to ensure that the leading edge of each cutting element 101 may achieve its intended depth of cut, or at least be in contact with the rock during drilling. For example, the cutting elements 101 may be oriented in the sockets 220 in the same orientation, such as with a specific portion, such as a leading (or cutting) edge, of each cutting element pointing in the same direction. In another example, the cutting elements 101 may be oriented in a pattern such that a specific point, such as the leading edge of each of the cutting elements 101, points towards the nose 218 and the relative angle of each leading edge is shifted away from the nose 218 the further from the nose 218 the cutting element 101 is positioned. In yet another example, the orientation of the cutting elements 101 positioned about the nose 218 of the drill bit 112 may be offset at an angle, such as about 90 degrees, from an orientation of those cutting elements 101 positioned near a periphery of the bit body 214.

FIGS. 3A-3E depict the cutting element 101 in greater detail. Additional views of the cutting element 101 are provided in FIGS. 4A-4G. A face (or working surface) 328 at an exposed end of each cutting element 101 as mounted in bit body 214 includes geometric partitions of surface area along the face 328, each having a functional role in abrading/shearing, excavating, and removing rock from beneath the drill bit 112 during rotary drilling operations.

As illustrated, each cutting element 101 includes a diamond (e.g., polycrystalline diamond ("PCD")) layer 324 bonded to a less hard substrate 326. While a single diamond layer 324 and substrate 326 are depicted, one or more layers of one or more materials may be provided as the layer, substrate and/or other portions of the cutting element 101.

The cutting elements described herein may be formed of various materials. For example, the substrate 326 may be made of tungsten carbide and the diamond layer may be formed of various materials including diamond. Other layers and/or portions of may optionally be provided. Part and/or all of the diamond layer (e.g., chamfer 336) may be leached, finished, polished, and/or otherwise treated to enhance operation. Examples of materials and/or treatments, such as leaching are described in Patent/Application Nos. U.S. 61/694,652, W02014/036283, W02012/056196, W02012/012774, US2012/0018223, US2011/0031028, US2011/0212303, US2012/0152622, and/or US2010/0200305, the entire contents of which are hereby incorporated by reference herein.

When inserted into a socket 220 of the bit body 214 as shown in FIGS. 2A-2B, an element body of the cutting element 101 is positioned with a diamond layer 324 extending outside of the socket 220 and has the face 328 at an end thereof for engagement with the wellbore. The cutting element 101 may have any suitable general configuration as will be evident to a skilled artisan, for example a generally cylindrical configuration as shown, and with a generally constant diameter D (e.g., about 16 mm) along about the entire length L (e.g., of about 13 mm) thereof.

The cutting element 101 may include a pair of side regions 330*a,b*, an elongated ridge 332, a ramp 334, and a chamfer 336 about the face 328. The side regions (or slanted surfaces) 330*a,b* extend from a periphery 338 of the cutting element 101 a distance therein. The regions 330*a,b* are generally pie shaped regions defined by an obtuse angle extending from a center C of the face 328 and a portion of the periphery 338. The side regions 330*a,b* may have any angle, such as a surface angle $\lambda$ of about 135 degrees, and a slant angle $\varphi$ of about 10 degrees (or from about 2 degrees to about 20 degrees). The regions 330*a,b* may be symmetrical relative to each other on either side of the ridge 332.

The ridge 332 is positioned along a side of each of the side regions 330*a,b* to separate the side regions 330*a,b*. The ridge 332 may be generally perpendicular to a leading edge 340 of the cutting element, and may be centrally oriented along the face 328. The ridge 332 extends from the leading edge 340, located at the periphery of the face 328, to about the center C of the face 328. The ridge 332 may extend along a portion of the diameter of the face 328, for example, from about ⅓ to ⅔ of a diameter D of the face 328.

The ridge 332 defines a protrusion extending from the chamfer 336 at the periphery 338 and to the center C of the face 328 between the regions 330*a,b*. The ridge 332 may have a length LR equal to a radius R of the face 328 and defines a side of the adjacent regions 330*a,b*. The radius R may have a length of about 8 mm. The ridge 332 may have a length defined for bisecting and physically splitting apart extruding rock particle conglomerates or extrudates and directing the smaller, split extrudate portions into the regions 330*a,b*.

The ridge 332 may have a uniform width along the entire length thereof and may have uniform height along the entire length thereof, or may possess a height that varies, such as by increasing from the end thereof proximate to the leading edge 340 to an opposite end thereof at a location at or near the ramp 334. The ridge 332 may have a width W of, for example, about 0.50 mm.

The chamfer 336 extends along a portion of the periphery 338 and defines the leading (or cutting) edge 340. The chamfer 336 as shown extends along about 10 degrees of the periphery 338 and has a height H of about 0.3 mm. The chamfer 336 may extend from about 2 degrees to about 360 degrees of the periphery 338. The leading edge 340 may be a portion of an edge of the cutting element 101 illustrated as being about the chamfer 336. The leading edge 340 may be dimensioned to achieve a generally predetermined depth-of-cut into rock.

The chamfer 336 may extend from the ridge 332 at a chamfer angle $\theta$ of about 45 degrees (or from about 15 degrees to about 75 degrees). The chamfer 336 may be formed along a peripheral end of the ridge 332 at the leading edge 340. By extending the ridge 332 to the periphery 338 of the cutting element 101, at the leading edge 340, the regions 330*a,b* and the ridge 332 may provide a leading edge 340 defined for splitting of the rock particle conglomerates or extrudates.

The ramp 334 defines a third pie shaped region extending from a central end of the ridge 332 and between adjacent regions 330*a,b*. The ramp 334 provides a surface to define rigid back support and stability to the regions 330*a,b*. The ramp 334 may extend from the ridge 332 and along the regions 330*a,b* at a ramp angle $\alpha$ of about 90 degrees between the regions 330*a,b*. The ramp angle $\alpha$ may also extend at any angle, such as from about 60 degrees to about 120 degrees. The ramp 334 may also have an incline angle $\beta$ of, for example, of about 10 degrees.

In the example of FIG. 3A, the ramp 334 has a curved edge 335 along a periphery of the face and two sides 337*a,b*. Each of the two sides 337*a,b* extend from opposite ends of the curved edge 335 and converging at the location (e.g., center) C along the face 328. The ridge 332 is between the chamfer 336 and the location C. Each of the pair of side regions 330*a,b* is positioned on opposite sides of the ridge 332 and extends between the periphery 338, the ridge 332, and one of the two sides 337*a,b* of the ramp 334.

As shown by these views, the cutting element 101 is in a central configuration with the ridge 332 extending from a central area of the face 328 of the cutting element 101. As shown, the ridge 332 extends from the center C of the face 328 to divide the side regions 330*a,b* into equal portions. In this configuration, the ramp 334 and the side regions 330*a,b* are of a similar dimension. The ramp 334 and the side regions 330*a,b* may have any shape, such as planar (as shown), concave, and/or a combination of curved and/or planar surfaces. The ramp 334 may be shaped to flow drilling fluid toward the ridge 332 and the leading edge 340 and the chamfer 336 may be positioned to engage a wall of the wellbore such that extrudate is drawn along the pair of side regions during operation.

The cutting element 101 may also be provided with other features and/or geometries. For example, as shown in FIG. 3C, the cutting element 101 has a bottom surface (or end)

325 with a bevel 327 along the periphery 338. The bevel 327 may have a bevel angle ψ (in FIG. 3E) of about 45 degrees, or at an angle from about 35 degrees to about 50 degrees.

In operation, drilling fluid passing through the downhole tool 108 and out the drill bit 112 (FIG. 1) may flow through the passages 222 and over the cutting element(s) (e.g., 101) in the blades 216 (FIG. 2). The leading edge 340 of the cutting elements(s) may engage and dislodge rock along the wellbore to form extrudates. The regions (e.g., 330*a,b*) may direct opposing forces to extrudates at positive non-zero angles to the two-dimensional plane of the leading edge 340. These forces may urge the extrudates into the drilling fluid until such point in time when the surface area of each extrudate exceeds a critical value and the extrudate is broken off into the flow regime of the drilling fluid. The ramp (e.g., 334) may be used to flow the drilling fluid toward the face (or working surface) (e.g., 328) to reduce interfacial friction between the working surface and rock extrudate and carry extrudate away as it is dislodged about the leading edge 340.

The configuration of the cutting elements may split extrudate in smaller portions without interrupting extrudate formation in such a way that limits the volume and mass (less energy of formation) of the extrudate. In this manner, reduced frictional forces between the cutter working surface and rock extrudate may result in extrudate removal with less EE. Accordingly, less input energy may be required to drill at given rate of penetration, thereby reducing MSE while drilling.

FIGS. 5A-7E depict views of additional versions of a cutting element 501,601, 701. FIGS. 5A-5E show the cutting element 501 in an offset configuration. FIGS. 6A-6E show the cutting element 601 having an offset, inward tapered configuration. FIGS. 7A-7E show the cutting element 701 having an offset, outward tapered configuration. The cutting elements 501, 601, 701 are similar to the cutting element 101, except that the cutting elements 501, 601, 701 may have a ridge 532, 632, 732 positioned a distance from a center of the face 528, 628, 728, and/or may have various shapes.

In the example of FIGS. 5A-5E, the cutting element 501 has the face 528 with side portions 530*a,b*, the ridge 532, and a ramp 534. The cutting element 501 is similar to the cutting element 101, except that the ridge 532 extends from a periphery 538 to a location a distance from the center C. As shown by this example, the ridge 532 may have a length LR1 that is less than ½ of the diameter D (and less than the radius R) of the face 528 (e.g., about ⅓ of the diameter D).

Figure 6A:
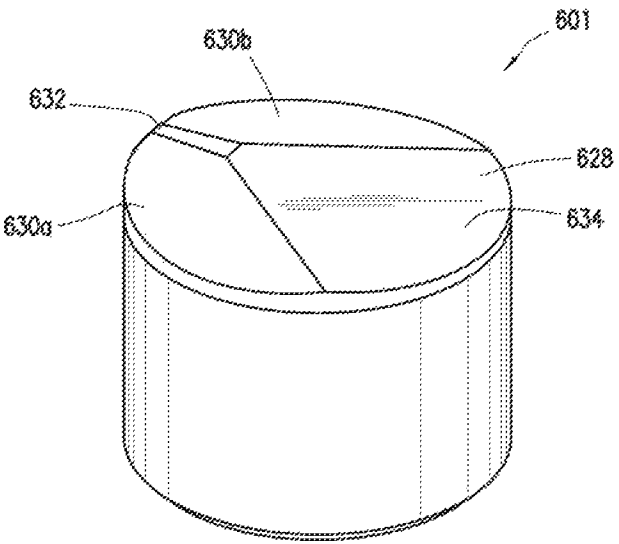
FIGS. 6A-6B are perspective and top views, respectively, of a cutting element having an offset, inward tapered configuration.
Figure 5E:
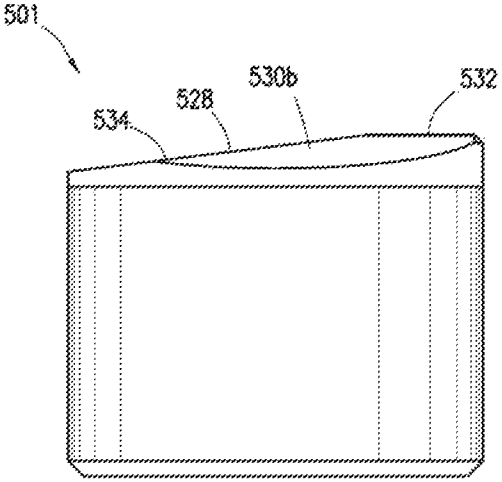
Figure 6B:
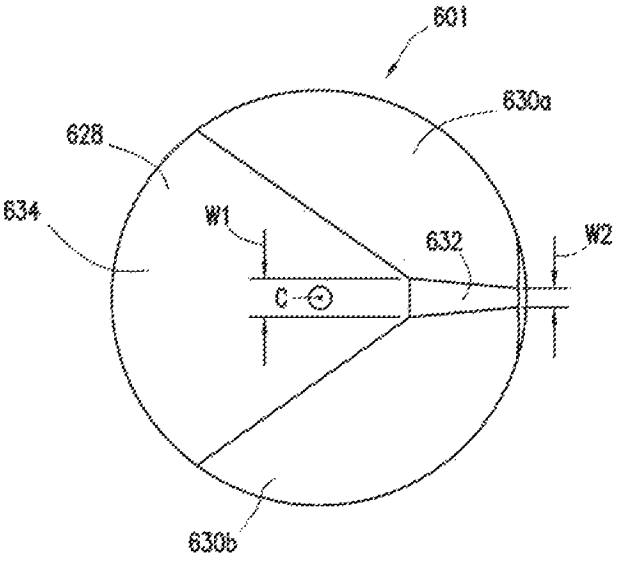

In the example of FIGS. 6A-6B, the cutting element 601 has the face 628 with side portions 630*a,b*, the ridge 632, a ramp 634. The cutting element 601 is similar to the cutting element 501, except that a width of the ridge 632 has an inward taper. As shown by this example, the ridge 632 may have a width W2 at the periphery and a wider width W1 at an opposite end.

Figure 7A:
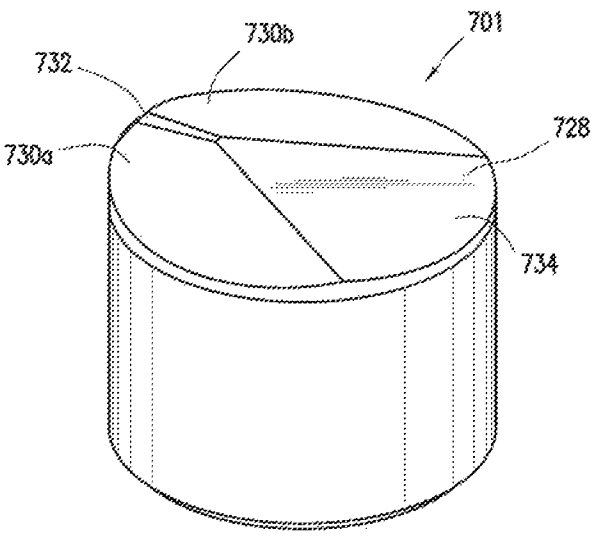
FIGS. 7A-7B are perspective and top views, respectively, of a cutting element having an offset, outward tapered configuration.
Figure 7B:
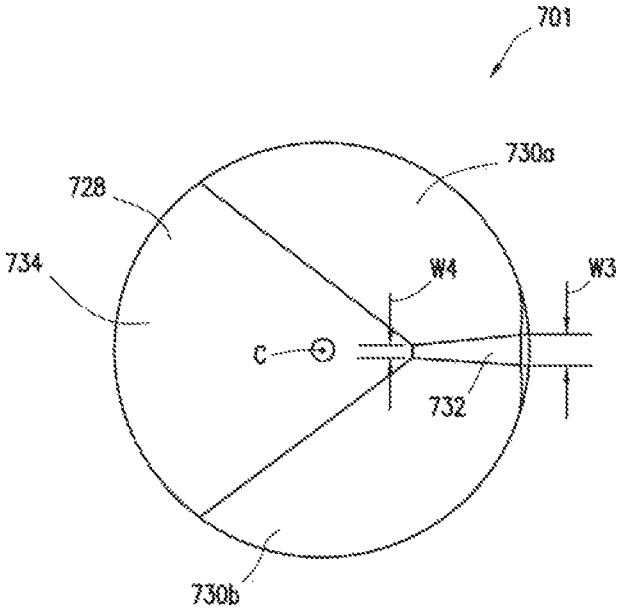

In the example of FIGS. 7A-7B, the cutting element 701 has the face 728 with side portions 730*a,b*, the ridge 732, a ramp 734. The cutting element 701 is similar to the cutting element 601, except that a width of the ridge 732 has an outward taper. As shown by this example, the ridge 732 may have a width length W3 at the periphery and a narrower width W4 a tan opposite end.

Figure 8:
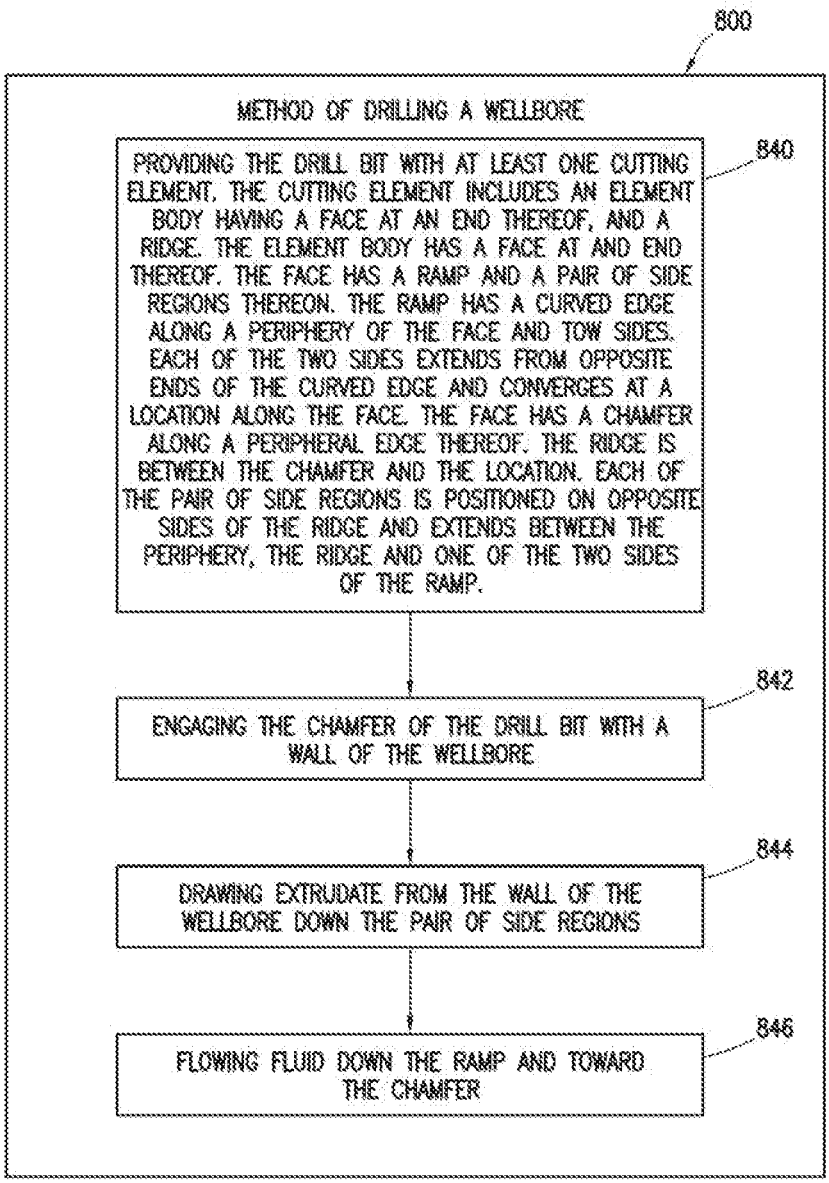
FIG. 8 is a flow chart depicting a method of drilling a wellbore.

FIG. 8 is a flow chart depicting a method 800 of drilling a wellbore. The method involves 840 providing the drill bit with at least one cutting element. The cutting element includes an element body having a face at an end thereof, and a ridge. The element body has a face at an end thereof. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp.

The method may also involves 842 engaging the chamfer of the drill bit with a wall of the wellbore, 844 drawing extrudate from the wall of the wellbore down the pair of side regions, and/or 846 flowing fluid down the ramp and toward the chamfer. The method may also involve advancing a drill bit into a subterranean formation to form a wellbore. The method may be performed in any order and repeated as needed.

While the subject matter has been described with respect to a limited number of embodiments, those skilled in the art, having benefit of this disclosure, will appreciate that other embodiments can be devised which do not depart from the scope of the subject matter as disclosed herein. Accordingly, the scope of the invention should be limited only by the attached claims.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming maybe accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and/or other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

The above description is illustrative of the preferred embodiment and many modifications may be made by those skilled in the art without departing from the invention whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible, such as such as location, shape, dimensions, and orientation of the regions, ridge, ramp, chamfer, etc. and materials used in their manufacture. Various combinations of the features provided herein may be utilized.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A cutting element for a drill bit configured to drill a borehole in a subterranean formation, the cutting element comprising:

a body having a face at an end thereof, wherein the face includes a ramp, a first side region, a second side region, and a ridge thereon;

wherein the ramp has a curved edge along a periphery of the face, a first side, and a second side, wherein the first side and the second side of the ramp extend from opposite ends of the curved edge and converge at a location along the face;

wherein the ridge extends along the face from the periphery of the face to the location, wherein the ridge is positioned between the first side region and the second side region;

wherein the first side region extends between the periphery, the ridge, and the first side of the ramp, wherein the second side region extends between the periphery, the ridge, and the second side of the ramp, and wherein the ramp extends from the first side region to the second side region.

2. The cutting element of claim 1, wherein the first side region and the second side region are curved.

3. The cutting element of claim 2, wherein the ramp is planar.

4. The cutting element of claim 1, wherein the first side region and the second side region are concave.

5. The cutting element of claim 4, wherein the ramp is planar.

6. The cutting element of claim 1, wherein the ramp is curved.

7. The cutting element of claim 1, wherein a ramp angle $\alpha$ between the first side and the second side is 60° to 120°.

8. The cutting element of claim 2, wherein the ramp angle $\alpha$ is 90°.

9. The cutting element of claim 1, wherein a surface angle $\lambda$ along the first side region between the ridge and the first side of the ramp is 135°.

10. The cutting element of claim 1, wherein the ramp, the first side, and the second slide sides slope upward moving from the periphery to the location.

11. The cutting element of claim 1, wherein the ridge has a length ranging from ⅓ to ⅔ of a diameter of the face.

12. The cutting element of claim 1, wherein the ridge has a length that is less than ½ a diameter of the face.

13. The cutting element of claim 1, wherein the ridge has a width W that increases or decreases moving from the location to the periphery of the face.

14. The cutting element of claim 1, wherein the location is spaced from a center of the face.

15. The cutting element of claim 1, wherein a chamfer is disposed along the periphery of the face, and wherein the ramp extends from the chamfer to the location.

16. The cutting element of claim 15, wherein the chamfer is disposed at a chamfer angle $\theta$ relative to a horizontal line, wherein the chamfer angle $\theta$ is 15° to 75°.

17. The cutting element of claim 15, wherein the chamfer defines a leading cutting edge of the cutting element for engagement with a wall of the wellbore.

18. A drill bit advanceable into a subterranean formation to form a wellbore, the drill bit comprising:

a bit body; and at least one cutting element of claim 1 mounted to the bit body.

19. A cutting element for a drill bit configured to drill a borehole in a subterranean formation, the cutting element comprising:

a substrate having a central axis;

a cutting layer bonded to the substrate, wherein the cutting layer includes a face configured to engage the formation;

wherein the face of the cutting layers comprises:

a ramp, a first side region, a second side region, and a raised ridge positioned between the first side region and the second side region;

wherein the ramp is defined by a periphery of the face, a first side extending along the first side region, and a second side extending along the second side region, wherein the first side and the second side of the ramp extend from the periphery of the face to a location along the face;

wherein the raised ridge extends along the face from the periphery of the face to the location;

wherein the first side region extends between the periphery of the face, the ridge, and the first side of the ramp, wherein the second side region extends between the periphery of the face, the ridge, and the second side of the ramp.

20. The cutting element of claim 19, wherein the first side region and the second side region are curved.

21. The cutting element of claim 20, wherein the ramp is planar.

22. The cutting element of claim 19, wherein the first side region and the second side region are concave.

23. The cutting element of claim 22, wherein the ramp is planar.

24. The cutting element of claim 19, wherein the ramp is curved.

25. The cutting element of claim 19, wherein a ramp angle $\alpha$ between the first side and the second side is 60° to 120°.

26. The cutting element of claim 19, wherein the ramp, the first side, and the second slide sides slope upward moving from the periphery to the location.

27. The cutting element of claim 19, wherein the ridge has a length that is less than ½ a diameter of the face.

28. The cutting element of claim 19, wherein the ridge has a width W that increases or decreases moving from the location to the periphery of the face.

29. The cutting element of claim 19, wherein the location is spaced from a center of the face.

* * * * *